US011577150B2

(12) United States Patent
Ritter

(10) Patent No.: US 11,577,150 B2
(45) Date of Patent: Feb. 14, 2023

(54) SYSTEMS AND METHODS OF FASTENING SPLITBOARD SKIS

(71) Applicant: SPARK R&D IP HOLDINGS, LLC, Bozeman, MT (US)

(72) Inventor: William J. Ritter, Bozeman, MT (US)

(73) Assignee: SPARK R&D IP HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 17/224,007

(22) Filed: Apr. 6, 2021

(65) Prior Publication Data

US 2021/0220721 A1 Jul. 22, 2021

Related U.S. Application Data

(63) Continuation of application No. 16/713,112, filed on Dec. 13, 2019, now Pat. No. 10,974,124, which is a continuation of application No. 16/146,876, filed on Sep. 28, 2018, now Pat. No. 10,518,164.

(51) Int. Cl.
*A63C 5/02* (2006.01)
*A63C 5/03* (2006.01)

(52) U.S. Cl.
CPC ..... *A63C 5/031* (2013.01); *A63C 5/03* (2013.01); *A63C 2203/06* (2013.01)

(58) Field of Classification Search
CPC . A63C 2203/06; A63C 2203/10; A63C 5/031; A63C 5/033
See application file for complete search history.

(56) References Cited

U.S. PATENT DOCUMENTS 5,109,616 A 5/1992 Lush
5,462,318 A 10/1995 Cooke
5,551,728 A 9/1996 Barthel et al.
5,558,354 A 9/1996 Lion
5,649,722 A 7/1997 Champlin
5,660,416 A 8/1997 Schiele et al.
5,984,324 A 11/1999 Wariakois
6,464,423 B1 * 10/2002 Klein ..... A47B 87/002 292/202
6,523,851 B1 2/2003 Maravetz
(Continued)

FOREIGN PATENT DOCUMENTS

DE 9108618 11/1991
DE 19703774 8/1998
JP 5620597 11/2014

OTHER PUBLICATIONS

Voile Cam Bushings Instructions, Nov. 2014, Voile Manufacturing, Salt Lake City, Utah.
Voile Split Hook Cam Bushing Kit, accessed on the Internet at http://www.voile.com/voile-split-hook-cam-bushing-kit.html on Jan. 4, 2018.
Nitro Splitboard Hooks, Snowboard Zezula, accessed on the Internet at https://www.snowboard-zezula.com/nitro-splitboard-hooks/pn-94370 on Jan. 4, 2018.
(Continued)

*Primary Examiner* — Brian L Swenson
(74) *Attorney, Agent, or Firm* — Snell & Wilmer L.L.P.

(57) ABSTRACT

A splitboard fastening system is disclosed herein. The splitboard fastening system comprises a crossbar comprising a shear bushing interface and a hook, an eccentric post coupled to a lever and configured to engage an inside edge of the hook in response to rotation of the lever, and a shear bushing configured to engage the shear bushing interface, wherein the crossbar is configured to be coupled to a first splitboard ski, and wherein the eccentric post and the shear bushing are configured to be independently coupled to a second splitboard ski.

6 Claims, 10 Drawing Sheets

(56) References Cited

U.S. PATENT DOCUMENTS

| | | | | |
|---|---|---|---|---|
| 8,033,564 | B2 | 10/2011 | Riepler et al. | |
| 8,469,372 | B2 | 6/2013 | Kloster et al. | |
| 8,708,371 | B2 | 4/2014 | Balun | |
| 8,733,783 | B2 | 5/2014 | Kloster et al. | |
| 8,764,043 | B2 | 7/2014 | Neubauer et al. | |
| 9,132,336 | B2 | 9/2015 | Bulan | |
| 9,138,628 | B2 | 9/2015 | Kloster et al. | |
| 9,227,131 | B2 | 1/2016 | Adamczewski et al. | |
| 9,238,168 | B2 | 1/2016 | Kloster et al. | |
| 9,266,010 | B2 | 2/2016 | Kloster et al. | |
| 9,604,122 | B2 | 3/2017 | Kloster et al. | |
| 9,744,431 | B2 * | 8/2017 | Etallaz | A63C 10/00 |
| 9,795,861 | B1 | 10/2017 | Kloster et al. | |
| 9,821,214 | B2 | 11/2017 | Browning | |
| 10,029,165 | B2 * | 7/2018 | Kloster | A63C 5/031 |
| 10,335,665 | B1 | 7/2019 | Ritter | |
| 10,518,164 | B1 | 12/2019 | Ritter | |
| 2008/0185814 | A1 | 8/2008 | Riepler | |
| 2010/0102522 | A1 | 4/2010 | Kloster | |
| 2012/0256395 | A1 | 10/2012 | Ritter | |
| 2012/0274036 | A1 | 11/2012 | Kloster et al. | |
| 2013/0193672 | A1 | 8/2013 | Bulan | |
| 2015/0014962 | A1 | 1/2015 | Rayner | |
| 2015/0157920 | A1 | 6/2015 | Adamczewski | |
| 2016/0175685 | A1 | 6/2016 | Kloster et al. | |
| 2016/0310824 | A1 | 10/2016 | Kloster et al. | |
| 2016/0310825 | A1 | 10/2016 | Kloster et al. | |
| 2017/0050105 | A1 | 2/2017 | Browning | |
| 2018/0140930 | A1 | 5/2018 | Kloster et al. | |
| 2018/0140931 | A1 | 5/2018 | Kloster et al. | |
| 2018/0180078 | A1 * | 6/2018 | Keffler | F16B 5/07 |

OTHER PUBLICATIONS

Fritschi Tour Snowboard Bindings, from Nitro Snowboards 1993-1994 Catalog, Jan. 1993, Nitro Snowboards, Oberammergau, Germany.

Phantom Splitboard Bindings, accessed on the Internet at http://www.phantomsnow.com/shop/parts-accessories/hercules-hooks/ on Jan. 4, 2018.

Crochets WOM, Hook WOM Pack for splitboards, accessed on the Internet at https://www.fixation-plum.com/en/accessoires-splitboard/6000-crochets-wom.html on Jan. 4, 2018.

Cowboy Clips, accessed on the Internet at https://www.prowder.com/product/cowboy-clips/ on Jan. 4, 2018.

Splitlock Technology, Oz Snowboards, accessed on the Internet at https://www.ozsnowboards.com/pages/splitlock on Jan. 4, 2018.

SpurArt Splitboard Hooks, Flickr, accessed on the Internet at https://www.flickr.com/photos/spurart/22721203059/in/photostream/ on Jan. 4, 2018.

USPTO, Non-Final Office Action dated Jul. 2, 2018 in U.S. Appl. No. 15/872,337.

USPTO, Non-Final Office Action dated Jul. 12, 2018 in U.S. Appl. No. 15/872,337.

USPTO, Notice of Allowance dated Jan. 25, 2019 in U.S. Appl. No. 15/872,337.

USPTO, Non-Final Office Action dated Feb. 21, 2019 in U.S. Appl. No. 16/146,876.

USPTO, Notice of Allowance dated Aug. 28, 2019 in U.S. Appl. No. 16/146,876.

USPTO, Non-Final Office Action dated Sep. 25, 2020 in U.S. Appl. No. 16/713,112.

USPTO, Notice of Allowance dated Dec. 16, 2020 in U.S. Appl. No. 16/713,112.

* cited by examiner

SYSTEMS AND METHODS OF FASTENING SPLITBOARD SKIS

CROSS REFERENCE TO RELATED APPLICATIONS

This application in a continuation of U.S. patent application Ser. No. 16/713,112, filed Dec. 13, 2019 entitled "SYSTEMS AND METHODS OF FASTENING SPLITBOARD SKIS," which is a continuation of U.S. patent application Ser. No. 16/146,876, filed Sep. 28, 2018 entitled "SYSTEMS AND METHODS OF FASTENING SPLITBOARD SKIS", both of which are incorporated by reference in their entirety.

FIELD

The present disclosure relates to splitboard fastening devices, and more specifically to a crossbar and lever splitboard fastening system.

BACKGROUND

A splitboard is a type of snow sport equipment that combines the features of a snowboard and snow skis. Splitboards can be optionally separated into two splitboard skis, or coupled to create a unitary snowboard. Typically, users operate the splitboard as separate splitboard skis, known as touring mode, when climbing uphill or cross-country skiing; users operate the splitboard as a joined snowboard, known as riding mode, when negotiating downhill slopes.

Riding mode requires a sturdy union at the seam between the two splitboard skis. Looseness or play along the center seam between the two splitboard skis alters the torsional and bending stiffness of the snowboard, causing it to behave unpredictably. Shear forces between the seam and the board face can cause up and down motion of one splitboard ski relative to the other. Unpredictable board movement and shear may cause a rider to lose control of the board or catch an edge in the snow, causing the rider to fall.

Latching devices can be placed at the center seam of the two splitboard skis to increase torsional stiffness. However, conventional latching devices are not easily adjustable to tolerances required by different splitboard manufacturers and do not allow for fast, in situ latching and unlatching, as may be desired by splitboard riders.

SUMMARY

In various embodiments, the present disclosure provides a splitboard fastening system. The splitboard fastening system comprises a crossbar comprising a shear bushing interface and a hook, an eccentric post coupled to a lever and configured to engage an inside edge of the hook in response to rotation of the lever, and a shear bushing configured to engage the shear bushing interface, wherein the crossbar is configured to be coupled to a first splitboard ski, and wherein the eccentric post and the shear bushing are configured to be independently coupled to a second splitboard ski.

In various embodiments, the crossbar comprises at least one of a lock stop or a stow stop. In various embodiments, the splitboard fastening system further comprises a ring bushing disposed about the eccentric post. In various embodiments, the splitboard fastening system further comprises an adjustment bracket disposed between the crossbar and an attachment bracket, wherein the adjustment bracket comprises at least one adjustment slot, wherein the attachment bracket comprises at least one attachment post disposed at least partially in the at least one adjustment slot, and wherein the adjustment bracket and the attachment bracket are configured to be coupled to the first splitboard ski. In various embodiments, the attachment bracket comprises a set screw, and wherein rotation of the set screw results in lateral translation of the adjustment bracket and the crossbar.

In various embodiments, the splitboard fastening system further comprises a disengaged configuration, wherein the crossbar is uncoupled from the shear bushing and the eccentric post, an unlocked configuration, wherein the eccentric post is disposed at the inside edge of the hook and wherein the shear bushing is disposed at least partially above the shear bushing interface, and a locked configuration, wherein the eccentric post is engaged with, and exerts a lateral force against the inside edge of the hook. In various embodiments, in the locked configuration, the lateral force is configured to create compression between the first splitboard ski and the second splitboard ski, and engagement between the shear bushing and the shear bushing interface is configured to prevent shear of the first splitboard ski relative to the second splitboard ski.

In various embodiments, the present disclosure provides a splitboard comprising a crossbar coupled to a first splitboard ski, the crossbar comprising a shear bushing interface and a hook, an eccentric post coupled to a second splitboard ski and a lever, wherein the lever is configured to rotate about an axis disposed perpendicular to a top surface of the splitboard, and a shear bushing coupled to the second splitboard ski and configured to engage the shear bushing interface. In various embodiments, the crossbar comprises at least one of a lock stop or a stow stop. In various embodiments, the splitboard further comprises a ring bushing disposed about the eccentric post.

In various embodiments, the splitboard further comprises an adjustment bracket disposed between the crossbar and an attachment bracket, wherein the adjustment bracket comprises at least one adjustment slot, wherein the attachment bracket comprises at least one attachment post disposed at least partially in the at least one adjustment slot, and wherein the adjustment bracket and the attachment bracket are coupled to the first splitboard ski. In various embodiments, the attachment bracket comprises a set screw, and wherein rotation of the set screw results in lateral translation of the adjustment bracket and the crossbar.

In various embodiments, the splitboard further comprises a disengaged configuration, wherein the crossbar is uncoupled from the shear bushing and the eccentric post, an unlocked configuration, wherein the eccentric post is disposed at the inside edge of the hook, and wherein the shear bushing is disposed at least partially above the shear bushing interface, and a locked configuration, wherein the eccentric post is engaged with, and exerts a lateral force against the inside edge of the hook. In various embodiments, in the locked configuration, the lateral force compresses the first splitboard ski and the second splitboard ski at a center seam, but does not restrict relative motion of the first splitboard ski and the second splitboard ski in directions perpendicular or parallel to the center seam.

In various embodiments, in at least one of the locked configuration or the unlocked configuration, the crossbar is disposed across the center seam, and engagement between the shear bushing and the shear bushing interface restricts relative perpendicular motion of the first splitboard ski and the second splitboard ski, but does not compress the first splitboard ski and the second splitboard ski at a center seam. In various embodiments, the splitboard further comprises a stowed configuration, wherein the crossbar is disposed on only one side of an inner edge of the first splitboard ski, and wherein the lever is disposed on only one side of an inner edge of the second splitboard ski.

In various embodiments, the present disclosure provides a method comprising rotating a crossbar until a lock stop of the crossbar engages at least one of an attachment bracket or an adjustment bracket, positioning a shear bushing interface of the crossbar beneath at least a portion of a shear bushing, positioning an inside edge of a hook disposed on the crossbar at least partially about an eccentric post, and rotating a lever coupled to the eccentric post in a first direction, wherein the crossbar is coupled to a first splitboard ski, and wherein the eccentric post and the shear bushing are independently coupled to a second splitboard ski.

In various embodiments, the method further comprises rotating the lever in a second direction, and disengaging the first splitboard ski from the second splitboard ski. In various embodiments, the method further comprises rotating the crossbar until a stow stop of the crossbar engages at least one of an attachment bracket or an adjustment bracket. In various embodiments, in response to rotating the lever in a first direction, the eccentric post engages with, and exerts a lateral force against, the inside edge of the hook.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
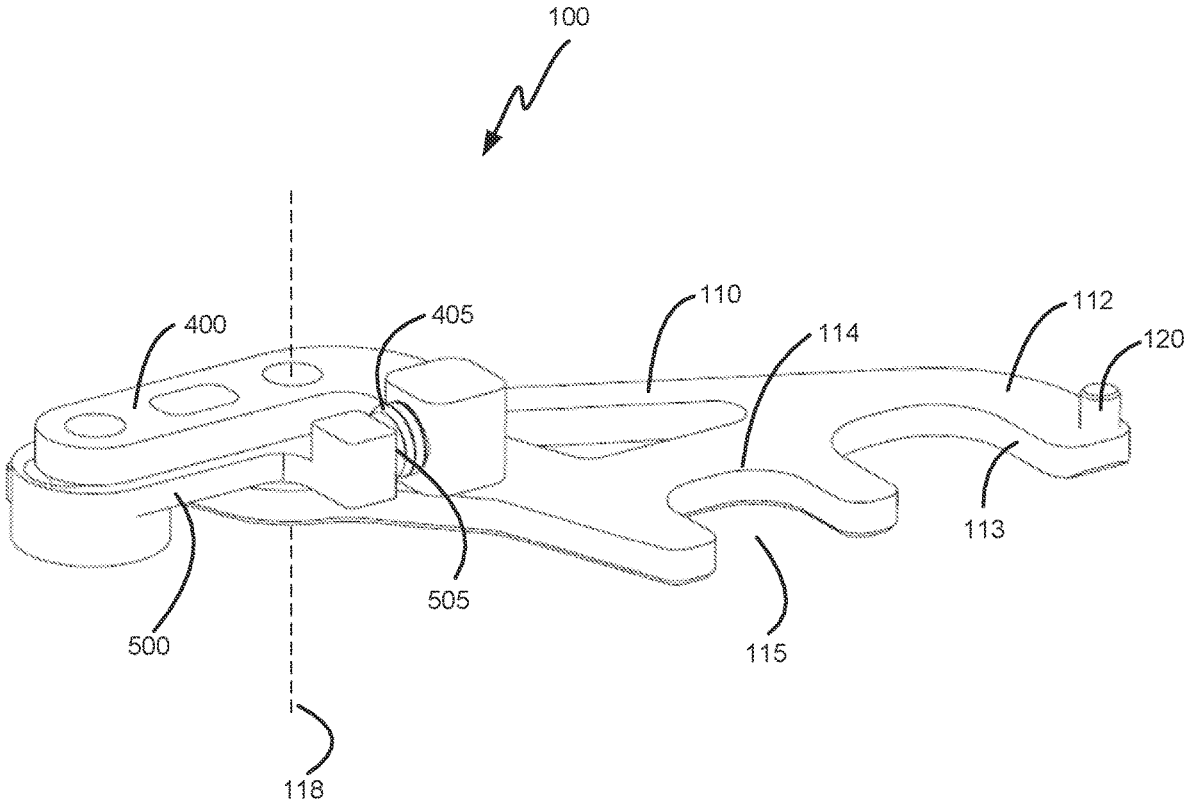
FIG. 1 is a perspective view of a crossbar attachment, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

Disclosed herein, according to various embodiments, are systems and methods of fastening splitboard skis. Generally, the splitboard fastening system disclosed herein comprises a crossbar attachment, a lever attachment, and a shear bushing as three separable components that may each be independently attached to a splitboard ski. As used herein, the term independently attached should be understood to mean that a first component may be attached to a first splitboard ski without attachment, coupling, engagement, or contact between the first splitboard ski and the other splitboard fastening system components. As described above, conventional splitboards have various shortcomings, especially pertaining to shear and other relative movement of the first splitboard ski to the second splitboard ski, and/or to the fixed and unadjustable nature of conventional splitboard latching components. Accordingly, the present disclosure provides features that decrease and/or prevent relative movement of the first splitboard ski to the second splitboard ski and also allow for fine adjustments of the splitboard fastening system components.

Various directions and perspectives are referenced herein to describe the features of the splitboard fastening system disclosed herein, particularly as they relate to the relative positions of the splitboard fastening system elements to one or more splitboard skis. With momentary reference to FIG. 8, the term "lateral," as used herein should be understood to mean movement along the y-axis. Splitboard skis referenced herein should be understood to be oriented such that a top surface of the splitboard skis (and/or the splitboard when the splitboard skis are joined) is disposed generally parallel to the x-y plane, and a center seam between a first splitboard ski and a second splitboard ski is oriented generally parallel to the x-axis and generally perpendicular to the y-axis. Relative movement of the first splitboard ski to the second splitboard ski in the z-direction may be referred to herein as relative perpendicular movement, or shear. Additional references to x-, y-, and z-axes and/or directions will be made throughout the disclosure, and should be understood to mean the x-, y-, and z-axes and/or directions shown in FIG. 8.

In various embodiments, a splitboard fastening system comprises a crossbar attachment configured to be independently attached to a first splitboard ski, a lever attachment configured to be independently attached to a second splitboard ski, and a shear bushing configured to be independently attached to the second splitboard ski. The crossbar may be configured to extend from the first splitboard ski, over a center seam between the first splitboard ski and the second splitboard ski, and onto the second splitboard ski. In various embodiments, the crossbar can engage a portion of the shear bushing to decrease or prevent shear without preventing relative movement of the first splitboard ski to the second splitboard ski in the x-direction. In various embodiments, the lever attachment can engage a portion of the crossbar to create compression between the first splitboard ski and the second splitboard ski without preventing shear.

Figure 2A:
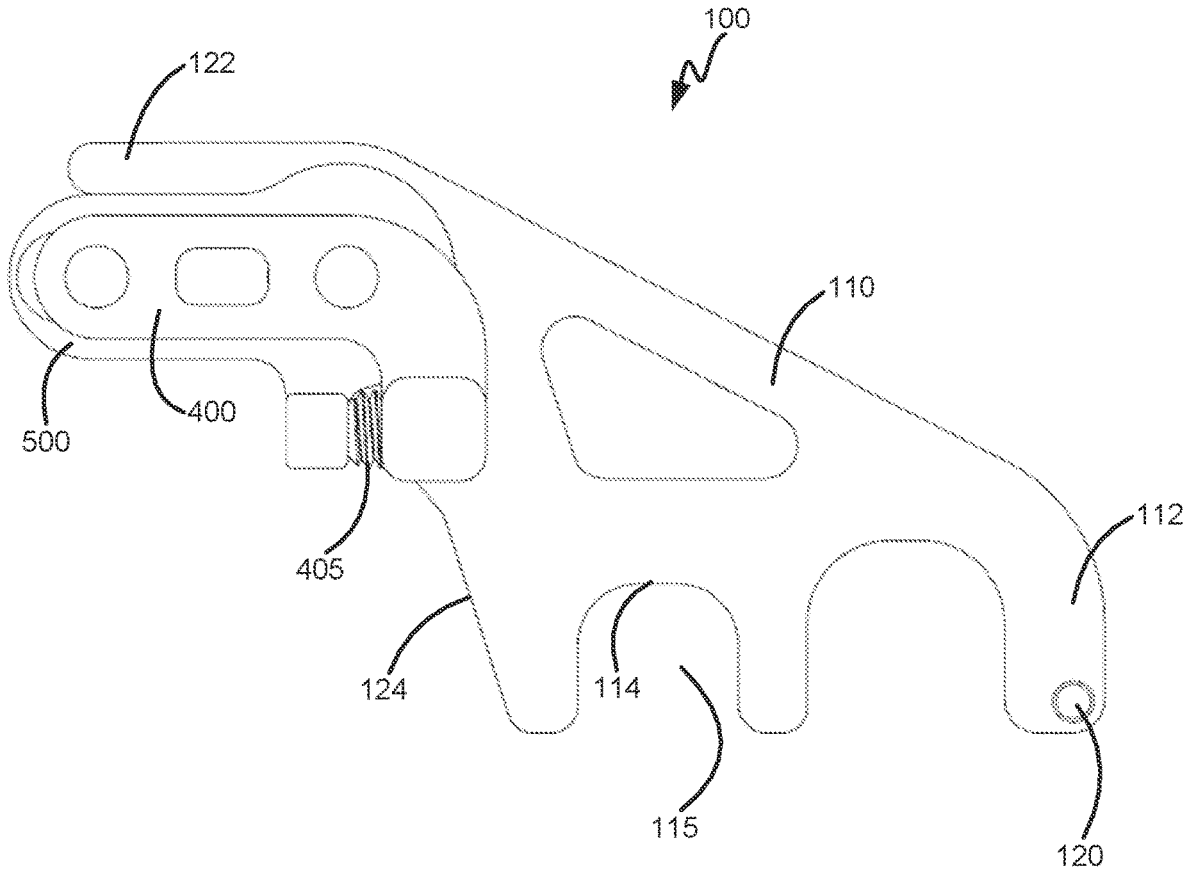
FIG. 2A is a top view of a crossbar attachment, in accordance with various embodiments.
Figure 2B:
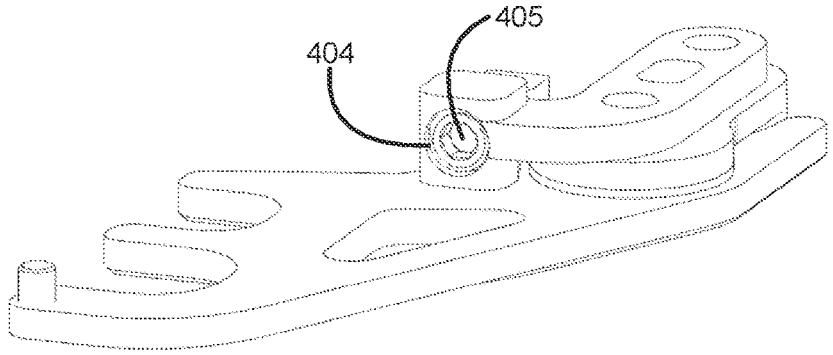
FIG. 2B is a perspective view of a crossbar attachment, in accordance with various embodiments.
Figure 3:
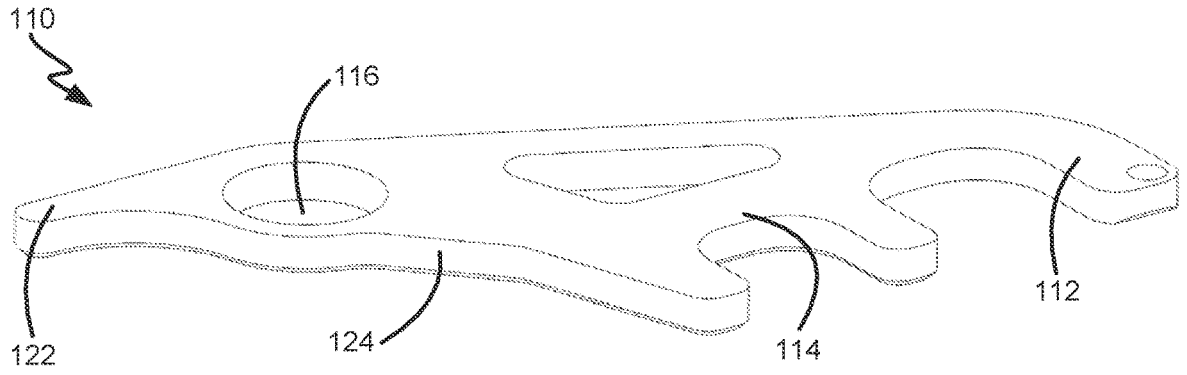
FIGS. 3-5 are perspective views of portions of a crossbar attachment, in accordance with various embodiments.

In various embodiments, and with reference to FIGS. 1-3, a crossbar attachment 100 comprises a crossbar 110 having a hook 112. Hook 112 may be disposed on a lateral end of crossbar 110, or may be disposed on any other portion of crossbar 110 suitable for engagement with a lever attachment of a splitboard fastening system. In various embodiments, hook 112 may comprise a projection extending from crossbar 110 in the x-direction and having an inside edge 113. Inside edge 113 may be disposed generally parallel to the x-z plane, and may be configured to engage with a portion of the lever attachment of the splitboard fastening system. While hook 112 may comprise a hook-like shape in various embodiments, it should be appreciated that hook 112 may comprise any shape or configuration suitable for engaging a portion of the lever attachment and receiving a lateral force therefrom in a direction away from a first splitboard ski to which the crossbar is attached and towards a second splitboard ski.

In various embodiments, a shape of crossbar 110 defines a shear bushing recess 115 that is axially aligned along the y-axis with at least a portion of hook 112 and/or inside edge 113. Such axial alignment may facilitate compatibility of the splitboard fastening system with commercially available splitboards. However, shear bushing recess 115 may be disposed on any portion of crossbar 110 suitable for receipt of, and engagement with, a shear bushing attached to the second splitboard ski. In various embodiments, shear bushing recess 115 comprises a shear bushing interface 114 disposed substantially parallel to a top surface of the first splitboard ski. In various embodiments, shear bushing recess 115 and/or shear bushing interface 114 comprise a laterally-extending portion. In various embodiments, shear bushing recess 115 and/or shear bushing interface 114 comprise one or more portions projecting from the laterally-extending portion in the x-direction. In various embodiments, shear bushing recess 115 and/or shear bushing interface 114 comprise a "u" shape configured to receive and engage with a rounded edge of a shear bushing. In various embodiments, shear bushing recess 115 and/or shear bushing interface 114 comprise only the lateral portion, such that shear bushing recess 115 comprises a shallow arc or straight line. In various embodiments, shear bushing recess 115 and/or shear bushing interface 114 comprise any shape that is complementary to, and/or configured to facilitate engagement with, a shear bushing Crossbar 110 may be configured to attach to a first splitboard ski at or through a rotation aperture 116. Rotation aperture 116 may be disposed at or near a lateral end of crossbar 110 distal from hook 112 and/or shear bushing recess 115. Rotation aperture 116 may define an axis of rotation 118 disposed in the z-direction, about which crossbar 110 may rotate. In various embodiments, rotation of crossbar 110 about axis of rotation 118 causes shear bushing recess 115 and hook 112 to extend laterally beyond and/or hang over an inside edge of a first splitboard ski 182 parallel to a center seam 180 (with momentary reference to FIG. 8) of a splitboard.

In various embodiments, crossbar 110 further comprises additional apertures configured to reduce the weight of crossbar 110. In various embodiments, crossbar 110 further comprises a glove catch 120 disposed at a lateral end of crossbar 110 opposite rotation aperture 116. Glove catch 120 may comprise a projection extending in the z-direction from crossbar 110. Glove catch 120 may be configured to allow riders to find, catch, and/or grip crossbar 110 when wearing bulky winter gloves or mittens, and/or when snow buildup occurs on the splitboard during use.

In various embodiments, crossbar 110 further comprises a lock stop 122 and/or a stow stop 124. Lock stop 122 may be disposed on a lateral end of crossbar 110 opposite glove catch 120 and may comprise a projection extending laterally away from rotation aperture 116. Stow stop 124 may comprise an inside edge of crossbar 110 disposed laterally between rotation aperture 116 and shear bushing recess 115.

Figure 4:
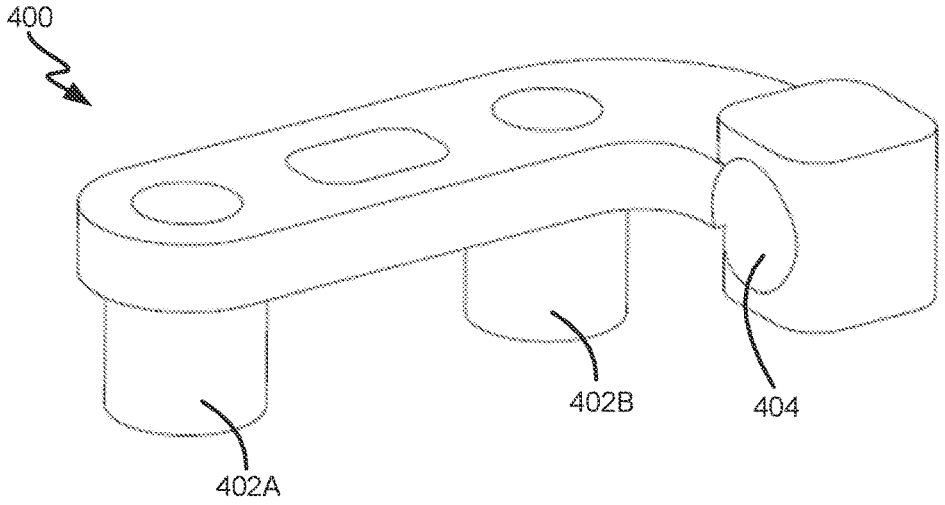
Figure 5:
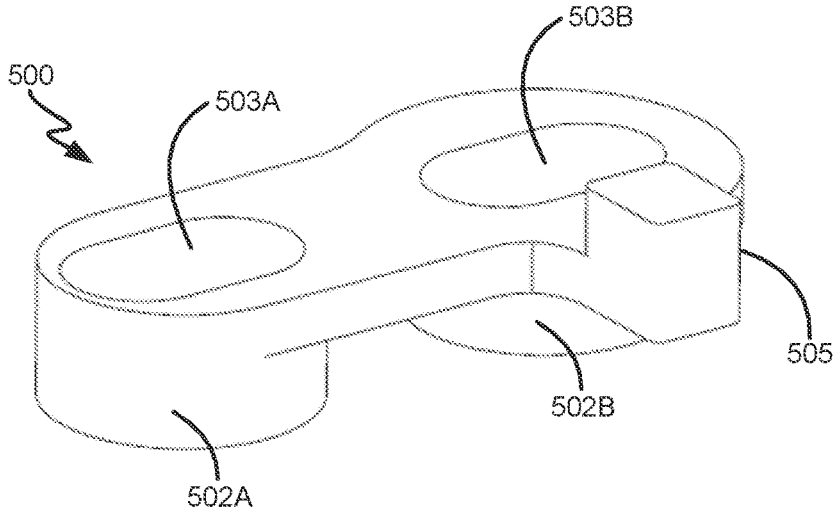

In various embodiments, crossbar 110 is attached directly to a first splitboard ski by a screw, threaded bushing, pin, bolt, rivet or any other suitable attachment mechanism disposed at or in rotation aperture 116. However, in various embodiments, crossbar attachment 100 further comprises at least one of an attachment bracket 400 and an adjustment bracket 500, with additional reference now to FIGS. 4 and 5.

Attachment bracket 400 may be configured to attach to a first splitboard ski through machined holes disposed in commercially available splitboards. In various embodiments, attachment bracket 400 comprises one or more attachment posts 402A, 402B. Attachment posts 402A, 402B may comprise threaded or unthreaded holes, bushings, top-mounted screws, bottom-mounted screws, pins, bolts, rivets or any other mechanism suitable for attaching attachment bracket 400 to a first splitboard ski. In various embodiments, attachment posts 402A, 402B comprise threaded holes configured to receive screws from the underside of the first splitboard ski.

In various embodiments, attachment bracket 400 further comprises a set screw aperture 404 and a set screw 405. Set screw aperture 404 may extend through a portion of attachment bracket 400 along the y-axis and may be configured to receive set screw 405 (for example, it may be threaded). Set screw 405 and/or set screw aperture 404 may comprise an axis of rotation substantially parallel to the y-axis such that rotation of set screw 405 causes lateral translation of its shaft in either direction.

Adjustment bracket 500 may be configured to cause lateral translation of crossbar 110 in response to rotation of set screw 405. In various embodiments, adjustment bracket 500 comprises one or more adjustment posts 502A, 502B through which is defined one or more adjustment slots 503A, 503B that extend from a top surface to a bottom surface of adjustment bracket 500. Adjustment slots 503A, 503B may be substantially stadium shaped or may otherwise comprise a lateral width greater than their height in the x-direction. However, adjustment slots 503A, 503B may comprise any shape suitable for receiving attachment posts 402A, 402B and accommodating lateral translation of adjustment bracket 500 relative to attachment bracket 400. In various embodiments, adjustment slots 503A, 503B comprise a lateral width configured to allow lateral translation of crossbar 110 of between about 0.1 inches and about 0.2 inches. In various embodiments, adjustment slots 503A, 503B comprise a lateral width configured to allow lateral translation of crossbar 110 of between about 0.125 inches and about 0.175 inches. However, adjustment slots 503A, 503B may comprise any lateral width configured to allow a suitable adjustment or lateral translation of crossbar 110. Adjustment bracket 500 further comprises a set screw interface 505 configured to be axially aligned with set screw 405 along the y-axis.

In various embodiments, attachment bracket 400 is coupled to adjustment bracket by placement of attachment posts 402A, 402B into adjustment slots 503A, 503B, and crossbar 110 is coupled to attachment bracket 400 by placement of at least one of attachment post 402B or adjustment post 502B in rotation aperture 116. Attachment of attachment bracket 400 to the first splitboard ski therefore indirectly couples adjustment bracket 500 and crossbar 110 to the first splitboard ski. Because crossbar 110 is coupled to the first splitboard ski through attachment post 402B, crossbar remains rotatable about axis of rotation 118.

In various embodiments, rotation of set screw 405 causes a lateral force to be exerted by set screw 405 against set screw interface 505 in a direction away from center seam 180 (with momentary reference to FIG. 8), causing lateral translation of adjustment bracket 500. Lateral translation of adjustment bracket 500 and adjustment post 502B causes a lateral force to be exerted by adjustment post 502B against an inside edge of rotation aperture 116, causing lateral translation of crossbar 110. Through rotation of set screw 405, therefore, the position of crossbar 110 relative to the center seam 180, a second splitboard ski, a lever attachment, and/or a shear bushing may be finely adjusted to accommodate the dimensions of the rider's splitboard.

Figure 6A:
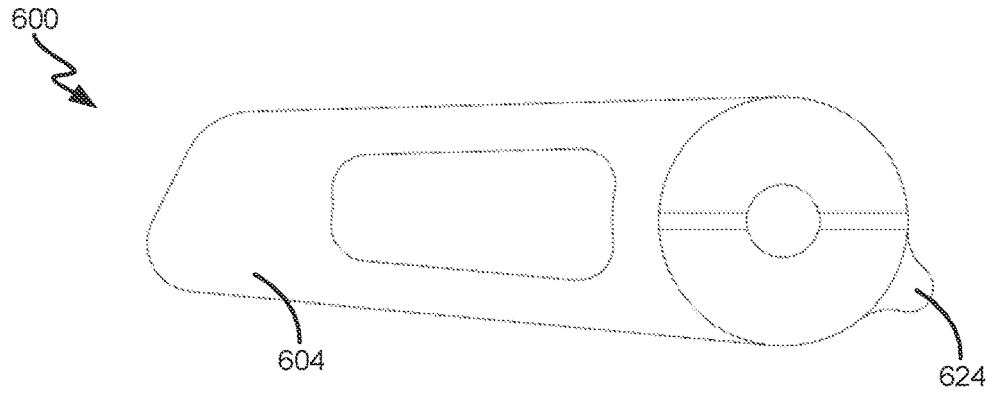
FIG. 6A is a top view of a lever attachment, in accordance with various embodiments.
Figure 6B:
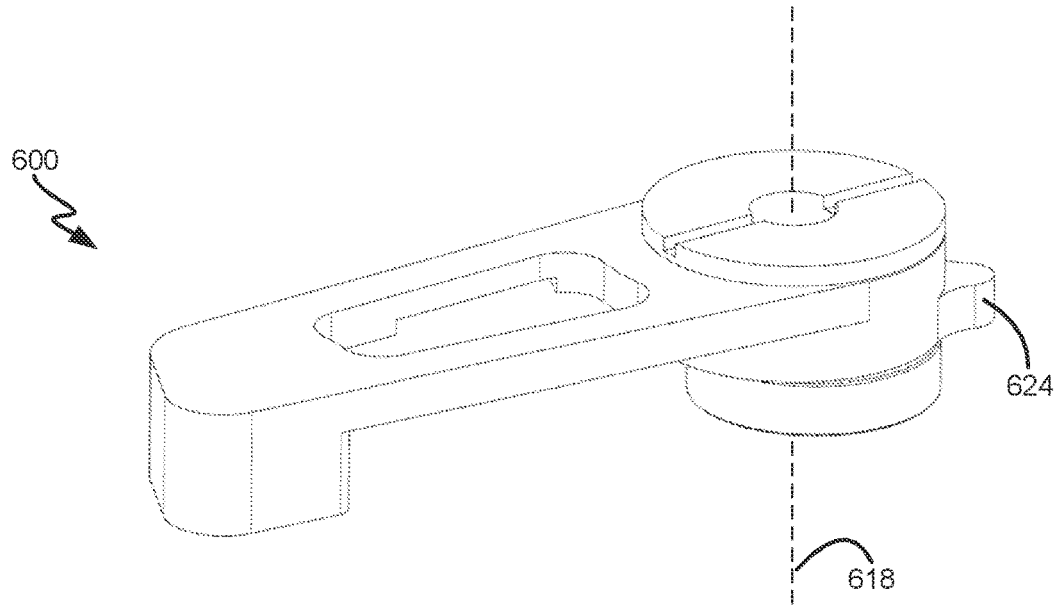
FIG. 6B is a perspective view of a lever attachment, in accordance with various embodiments.
Figure 6C:
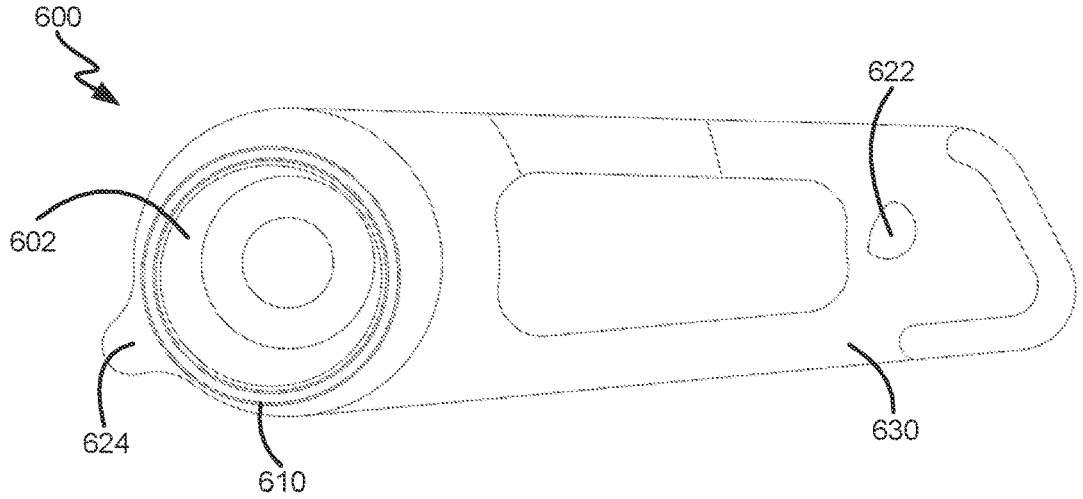
FIG. 6C is a bottom view of a lever attachment, in accordance with various embodiments.

With reference now to FIGS. 6A-6C, a splitboard fastening system further comprises a lever attachment 600. Lever attachment 600 may comprise an eccentric post 602 coupled to a lever 604. Lever attachment 600 may be configured to be attached to a second splitboard ski through an aperture disposed in eccentric post 602 and extending from a top surface of eccentric post 602 to a bottom surface of eccentric post. In various embodiments, lever attachment 600 may be configured to attach to a second splitboard ski through machined holes disposed in commercially available splitboards. The aperture disposed in eccentric post 602 may comprise or receive threaded or unthreaded bushings, top-mounted screws, bottom-mounted screws, pins, bolts, rivets or any other mechanism suitable for attaching lever attachment 600 to a second splitboard ski. In various embodiments, a threaded bushing is disposed in the aperture of eccentric post 602 and is configured to receive a screw from the underside of the second splitboard ski.

The lever 604 may extend outward from eccentric post 602 and may be disposed substantially parallel to the x-y plane. Lever 604 may be rotatable about an axis of rotation 618 such that rotation of lever 604 causes rotation of eccentric post 602 about axis of rotation 618. In various embodiments, lever 604 is shaped to improve a rider's ability to grab, catch, turn or otherwise manipulate lever 604. In certain embodiments, lever 604 comprises a laterally extending handle shape; however, the lever may comprise a knob, dial, protrusion, hook, or any other shape suitable for allowing a user to cause rotation of lever 604 and eccentric post 602 about axis of rotation 618. In various embodiments, lever attachment 600 further comprises a ring bushing 610 disposed concentric to eccentric post 602. Ring bushing 610 may be rotatable about an axis of rotation generally parallel to, but distinct from axis of rotation 618, and the rotation of ring bushing 610 may be independent of the rotation of eccentric post 602.

In various embodiments, lever attachment 600 further comprises at least one of a compression stop 622 or a release stop 624. Compression stop 622 and a release stop 624 may each be configured to allow rotation of lever 604 in a first direction and to prevent rotation of lever 604 in a second direction. In various embodiments, compression stop 622 comprises a projection or post extending from an underside 630 of lever 604 partially towards a top surface of the second splitboard ski in the z-direction. Compression stop 622 may be disposed at or near a first end of lever 604 distal from axis of rotation 618. In various embodiments, release stop 624 comprises a projection extending laterally from at or near a second end of lever 604 proximate to axis of rotation 618. As shown in FIG. 6C, release stop 624 may be disposed approximately radially outward from a portion of eccentric post 602 having the greatest radial distance from axis of rotation 618.

Figure 7A:
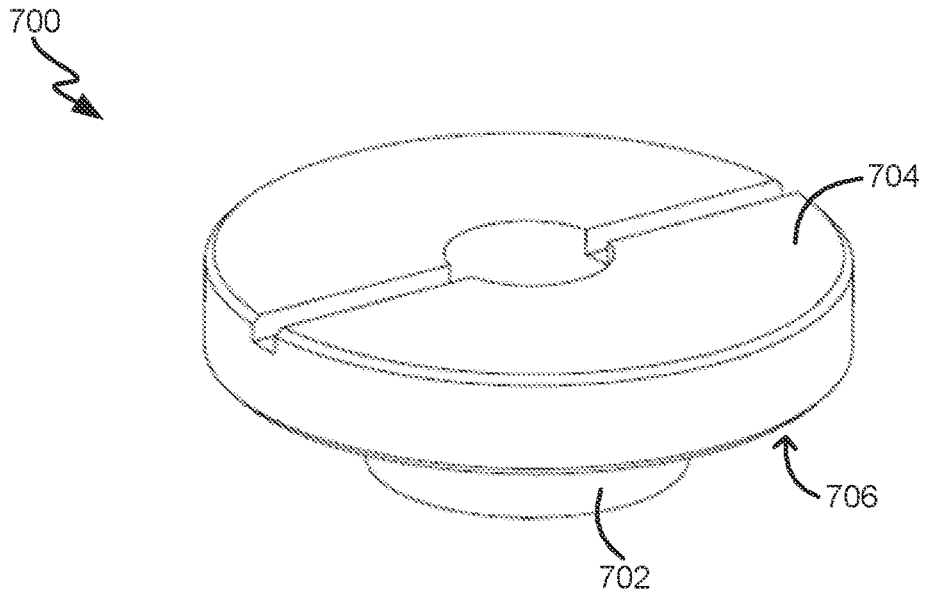
FIG. 7A is a perspective view of a shear bushing, in accordance with various embodiments.
Figure 7B:
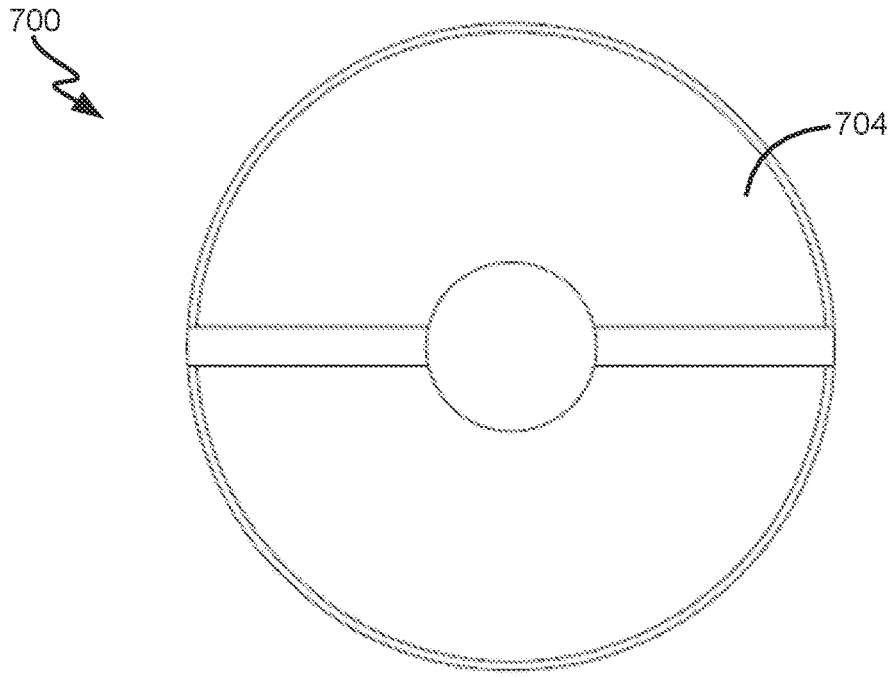
FIG. 7B is a top view of a shear bushing, in accordance with various embodiments.

With reference to FIGS. 7A and 7B, a splitboard fastening system may further comprise a shear bushing 700. In various embodiments, shear bushing 700 comprises a shear bushing post 702 and a flange 704. Shear bushing post 702 may be configured to attach to a second splitboard ski through machined holes disposed in commercially available splitboards. The shear bushing post 702 may comprise or receive threaded or unthreaded bushings, top-mounted screws, bottom-mounted screws, pins, bolts, rivets or any other mechanism suitable for attaching shear bushing 700 to a second splitboard ski. In various embodiments, shear bushing post 702 comprises a threaded bushing configured to receive a screw from the underside of the second splitboard ski.

Flange 704 may extend radially outward from a top end of shear bushing post 702. In various embodiments, an underside 706 of flange 704 is configured to engage shear bushing interface 114 of crossbar 110 (with momentary reference to FIG. 1). In various embodiments, flange 704 comprises a circular shape. However, flange 704 may comprise any shape suitable for causing engagement between an underside 706 of flange 704 and shear bushing interface 114.

In various embodiments and with reference now to FIGS. 8-11, a splitboard 800 comprising the splitboard fastening system described herein is disclosed. Splitboard 800 comprises a crossbar attachment 100 attached to a first splitboard ski 182, a shear bushing 700 independently attached to a second splitboard ski 183, and a lever attachment 600 independently attached to second splitboard ski 183. In various embodiments, shear bushing 700 and lever attachment 600 may be attached to second splitboard ski 183 along the same y-axis. Such an attachment configuration may facilitate use of splitboard fastening system with commercially available splitboards. In various embodiments, shear bushing 700 may be disposed closer to center seam 180 than lever attachment 600. In various embodiments, lever attachment 600 may be disposed closer to center seam 180 than shear bushing 700. As further described herein, splitboard 800 may comprise various configurations, optionally selectable by a rider and based on his or her intended use of splitboard 800.

Figure 8:
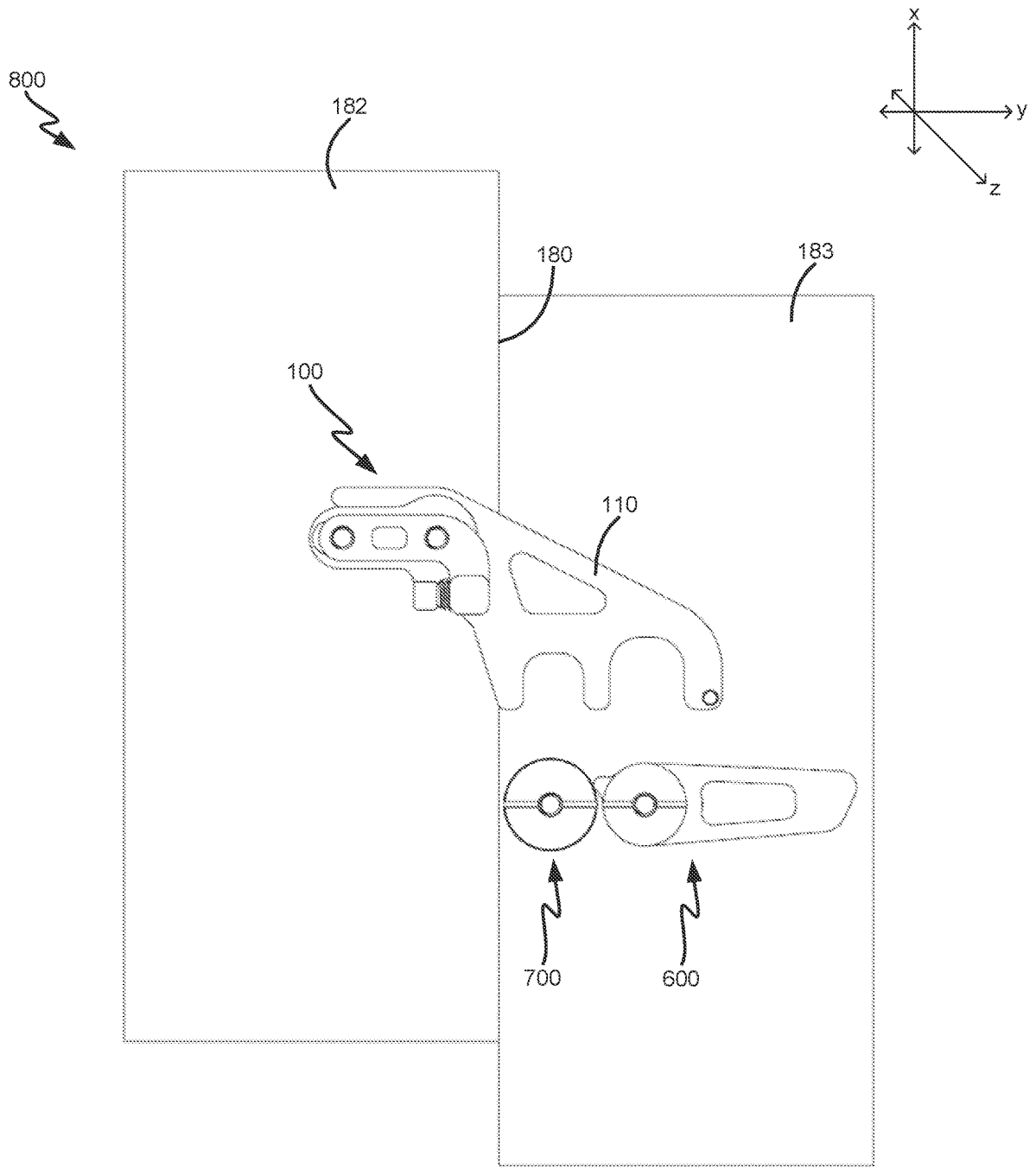
FIG. 8 is a top view of a portion of a splitboard, in accordance with various embodiments.

In various embodiments and with specific reference to FIG. 8, splitboard 800 comprises a disengaged configuration. In the disengaged configuration, crossbar 110 is uncoupled from each of shear bushing 700 and lever attachment 600. In the disengaged configuration, first splitboard ski 182 and second splitboard ski 183 are not compressed at center seam 180 and may or may not be coupled and/or in mechanical contact.

Figure 9A:
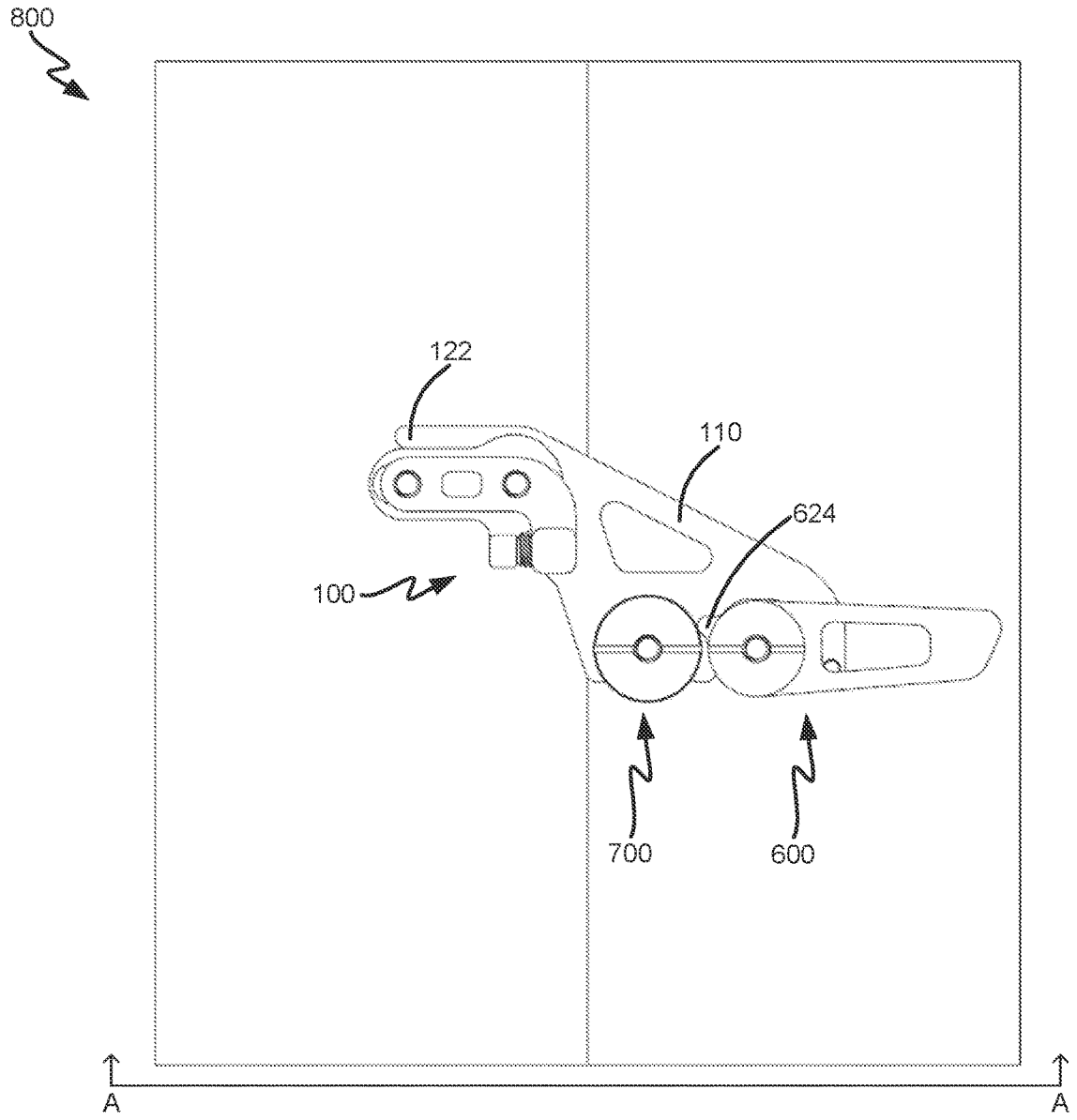
FIG. 9A is a top view of a portion of a splitboard, in accordance with various embodiments.
Figure 9B:
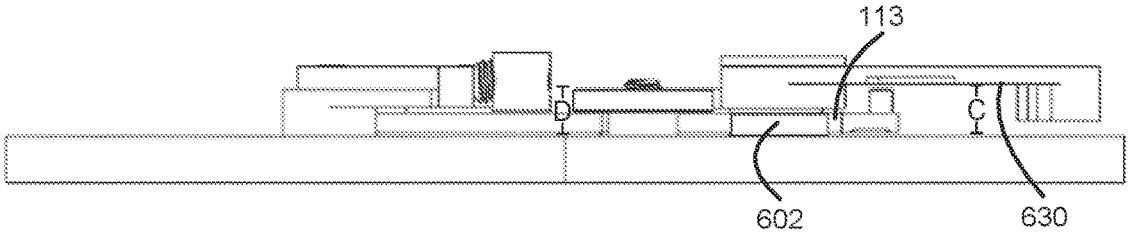
FIG. 9B is a view of Section A-A of FIG. 9A, in accordance with various embodiments.

In various embodiments and with specific reference to FIGS. 9A and 9B, splitboard 800 comprises an unlocked configuration. In the unlocked configuration, the shear bushing interface may be disposed beneath and engaged with shear bushing 700. In various embodiments, in the unlocked configuration, eccentric post 602 is disposed at, near, or in close proximity to, inside edge 113 of hook 112, without being engaged therewith and without exerting a lateral force thereon. In the unlocked position, tip ends and tail ends of first splitboard ski 182 and second splitboard ski 183 may be aligned.

In the unlocked configuration, crossbar 110 may have been rotated until lock stop 122 abuts at least one of attachment post 402A or adjustment post 502A, causing rotation of crossbar 110 to stop. Lock stop 122 may be configured to stop rotation of crossbar 110 when it is axially aligned with, and optimally positioned for, engagement with at least one of shear bushing 700 and lever attachment 600. In the unlocked configuration, lever attachment may have been rotated until release stop 624 abuts shear bushing 700, causing rotation of lever attachment 600 to stop. Release stop 624 may be configured to stop rotation of lever attachment 600 when the distance between eccentric post 602 and inside edge 113 of hook 112 is at or near its greatest. Stated differently, release stop 624 may be configured to facilitate improved clearance when coupling first splitboard ski 182 and second splitboard ski 183. In various embodiments, lock stop and/or release stop 624 improve the speed and ease with which a rider may couple first splitboard ski 182 and second splitboard ski 183.

Figure 10A:
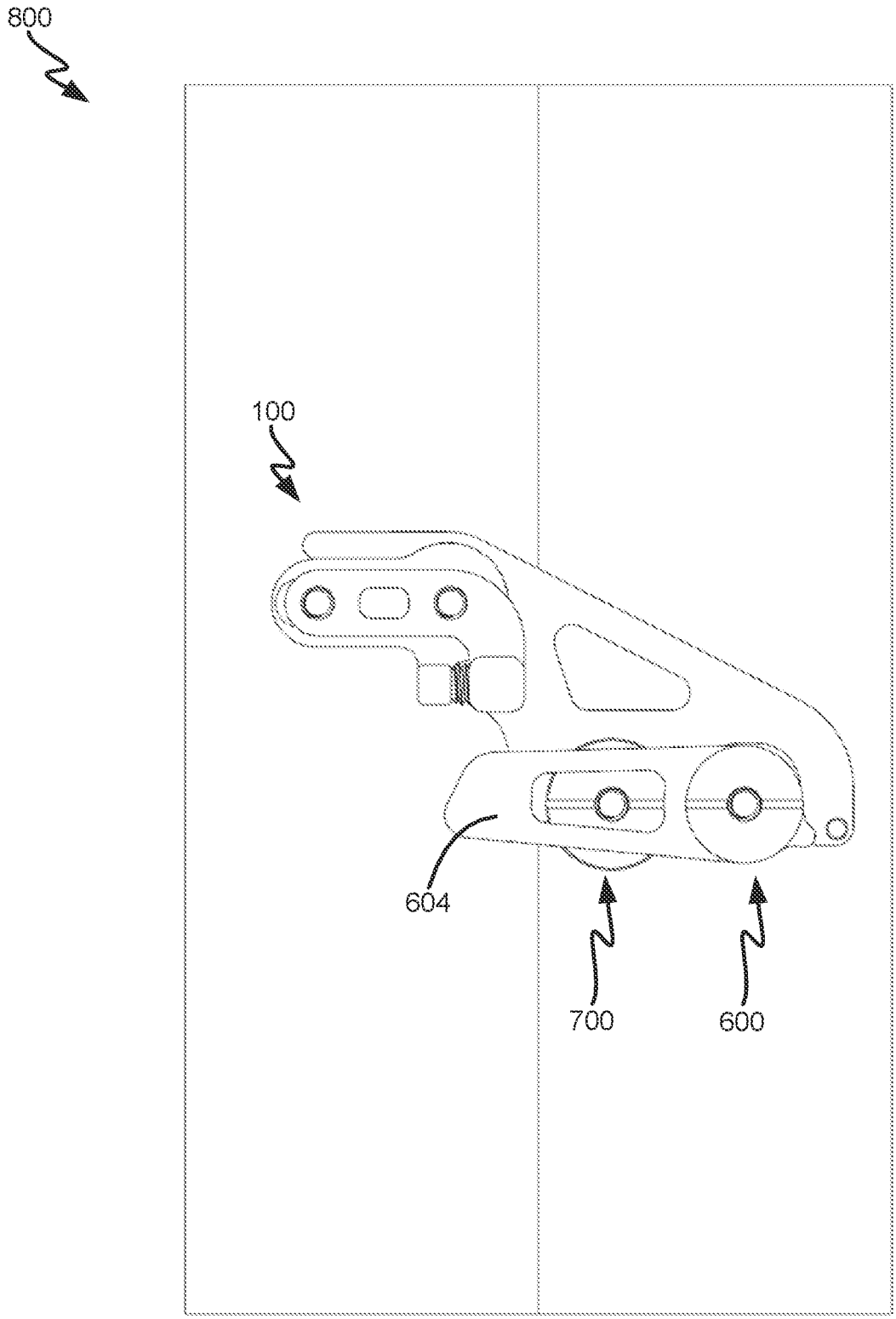
FIG. 10A is a top view of a portion of a splitboard, in accordance with various embodiments.
Figure 10B:
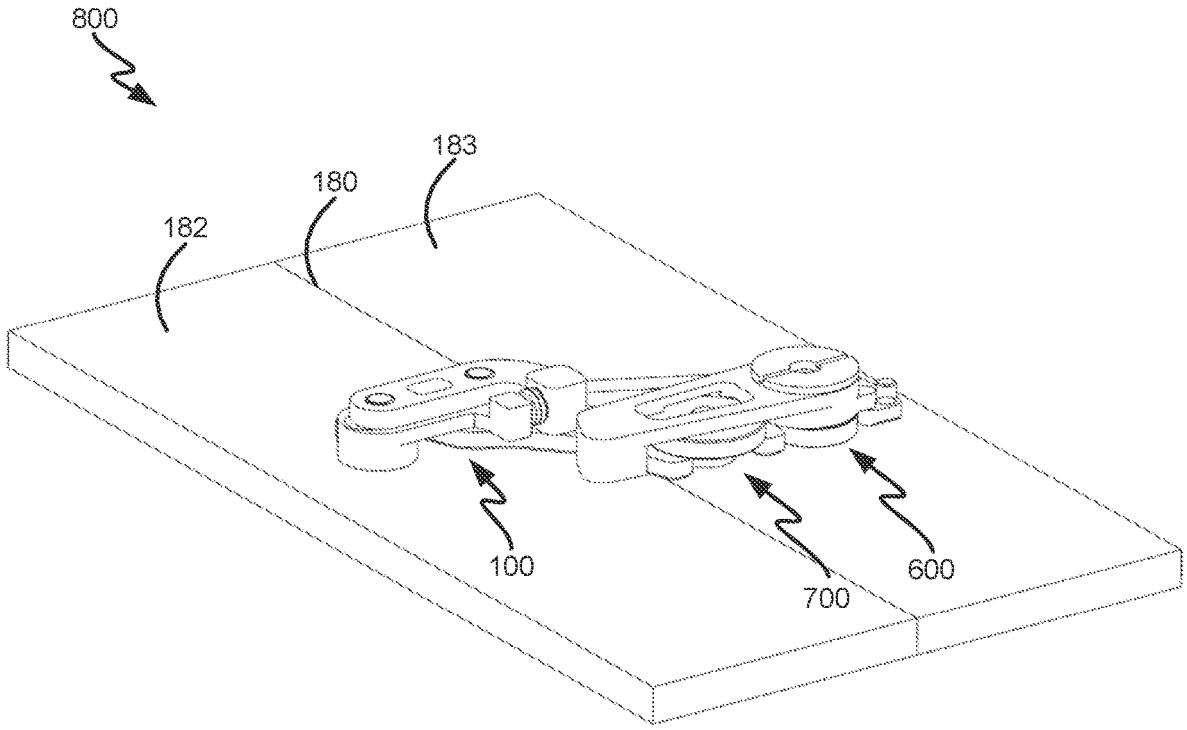
FIG. 10B is a perspective view of the splitboard of FIG. 10A, in accordance with various embodiments.

In various embodiments, and with specific reference to FIGS. 10A-10B, splitboard 800 comprises a locked configuration. In the locked configuration, the shear bushing interface may be disposed beneath, and engaged with, shear bushing 700. In the locked configuration, eccentric post 602 may be disposed at inside edge 113 of hook 112, may be engaged therewith, and may exert a lateral force thereon.

In various embodiments, ring bushing 610 (with momentary reference to FIG. 6C) is disposed between eccentric post 602 and inside edge 113, and the lateral force may be exerted through ring bushing 610. Because ring bushing 610 is configured to freely rotate about eccentric post 602, in the locked configuration, ring bushing 610 may allow fine adjustments of first splitboard ski 182 relative to second splitboard ski 183 in the x-direction while maintaining lateral compression between first splitboard ski 182 and second splitboard ski 183.

For example, in addition to operating splitboard latching devices, splitboard riders must adjust and attach boot bindings when switching from touring mode to riding mode. Boot bindings in riding bode cross the center seam and, therefore, require alignment of boot binding components attached, respectively, to a first splitboard ski and a second splitboard ski. Such alignment of boot bindings may cause misalignment or suboptimal alignment of a crossbar attachment to a shear bushing and/or a lever attachment of the present disclosure. In various embodiments, ring bushing 610 improves and/or optimizes alignment of crossbar attachment 100 to shear bushing 700 and/or lever attachment 600. In various embodiments, portions projecting from crossbar 110 in the x-direction to create shear bushing recess 115 and/or hook 112 may be configured with sufficient length to allow fine adjustments of first splitboard ski 182 relative to second splitboard ski 183 in the x-direction while maintaining lateral compression between first splitboard ski 182 and second splitboard ski 183. In various embodiments, portions projecting from crossbar 110 in the x-direction to create shear bushing recess 115 and/or hook 112 may be configured with sufficient length to allow fine adjustments of first splitboard ski 182 relative to second splitboard ski 183 in the x-direction while maintaining engagement between shear bushing interface 114 and shear bushing 700.

In the locked configuration, lever 604 may have been rotated until compression stop 622 abuts at least one of shear bushing 700 or crossbar 110 (for example, at stow stop 124 of crossbar 110), causing rotation of lever 604 and eccentric post 602 to stop. Compression stop 622 may be configured to stop rotation of eccentric post 602 when the lateral force exerted by eccentric post 602 against inside edge 113 is at or near its greatest. In various embodiments, compression stop 622 facilitates maximum compression of first splitboard ski 182 and second splitboard ski 183 by preventing over- or under-rotation of eccentric post 602.

However, in various embodiments, compression stop 622 is configured to stop rotation of eccentric post when it is slightly past the rotational position in which maximum lateral force is exerted by eccentric post 602 against inside edge 113. In such embodiments, the position of compression stop 622 and/or the position of lever 604 in the locked configuration may prevent or minimize unintentional counter-rotation of lever 604 such that the splitboard fastening system is brought out of the locked configuration.

In various embodiments, the eccentric portion of the lever comprises a boss and the inside edge of the hook of the crossbar further comprises a notch having a shape complementary to the boss. In various embodiments, the eccentric portion of the lever comprises a notch and the inside edge of the hook of the crossbar further comprises a boss having a shape complementary to the notch. In such configurations, rotation of the lever into the locked configuration, may cause the boss to engage with the notch, such that rotation of the lever away from the locked configuration. However, in various embodiments, splitboard fastening system comprises any detent suitable for discouraging or preventing unintentional rotation of the lever out of the locked configuration.

In various embodiments and with reference again to FIG. 9B, distance C is greater than distance D, such that underside 630 of lever attachment 600 will not engage shear bushing 700 or crossbar 110 in the locked configuration or the unlocked configuration.

Figure 11:
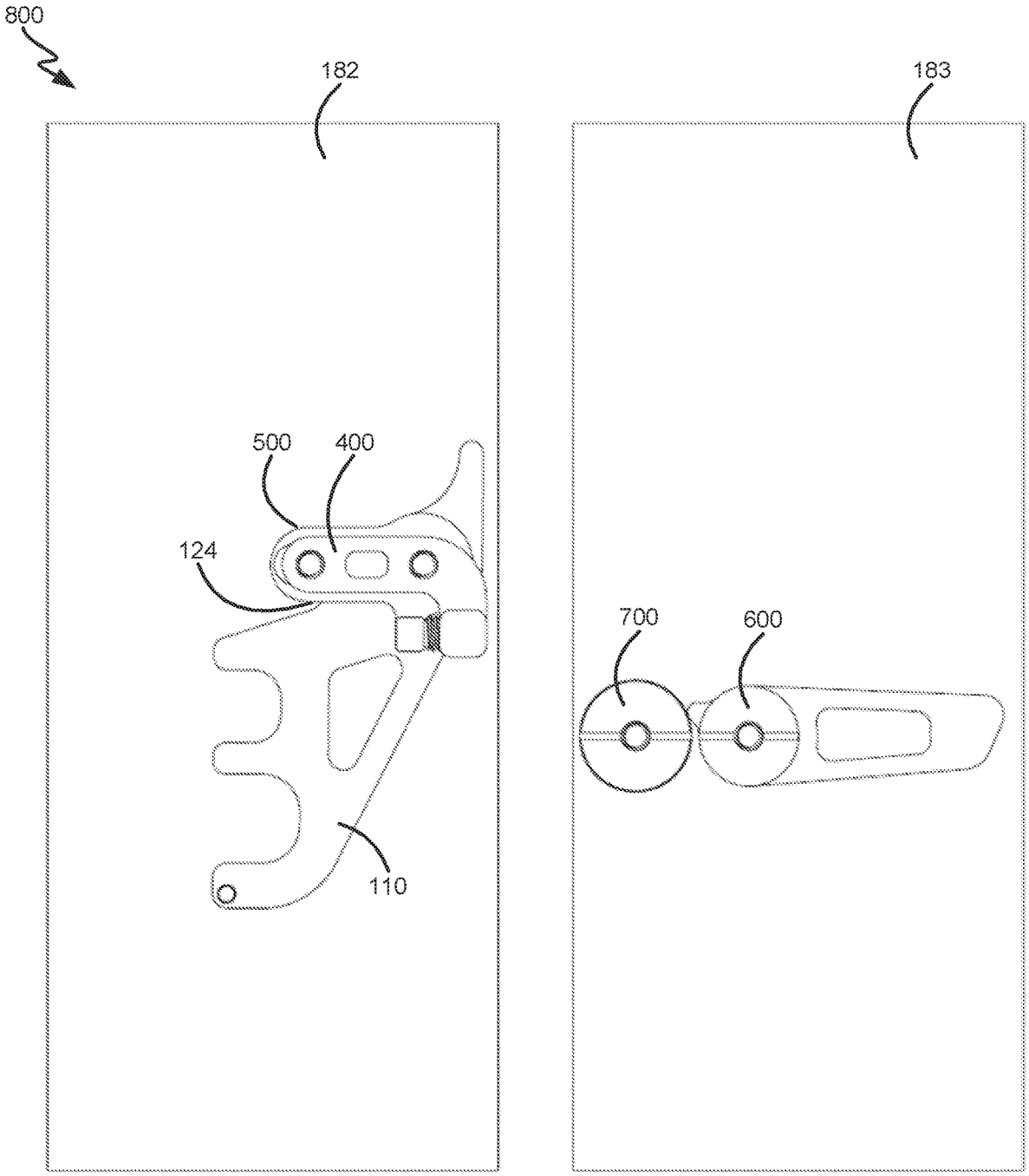
FIG. 11 is a top view of a portion of a splitboard, in accordance with various embodiments.

In various embodiments and with specific reference to FIG. 11, splitboard 800 comprises a stowed configuration. In the stowed configuration, crossbar 110 may be disengaged from shear bushing 700 and lever attachment 600, and first splitboard ski 182 may be disengaged from second splitboard ski 183. In the stowed configuration, crossbar 110 may have been rotated until stow stop 124 abuts at least one of attachment bracket 400 or adjustment bracket 500, causing rotation of crossbar 110 to stop. Stow stop 124 may be configured to stop rotation of crossbar 110 in a position where no portion of crossbar 110 overhangs the center seam or any outside edge of first splitboard ski. In the stowed configuration, lever attachment 600 may have been rotated to a position where no portion of lever attachment 600 overhangs the center seam or any outside edge of first splitboard ski. In various embodiments, the stowed configuration improves touring and protects components of the splitboard fastening system from damages and/or wear.

In various embodiments, components of the splitboard fastening system disclosed herein may comprise various materials. For example, components of the splitboard fastening system may comprise aluminum, brass, and/or stainless steel. In various embodiments, bushings including, without limitation, the ring bushing and the shear bushing may comprise brass; attachment components including, without limitation, screws may comprise stainless steel; and adjustable components including, without limitation, the lever the crossbar, the attachment bracket, and the adjustment bracket, may comprise aluminum. However, any components of the splitboard fastening system may comprise any suitable metal, alloy, plastic, ceramic, composite, or other composition. In various embodiments, one or more components of the splitboard fastening system are anodized, powder coated, painted, and/or otherwise treated prior to use. Components may be anodized, powder coated, painted, and/or otherwise treated for decorative purposes, to improve durability, to decrease and/or prevent corrosion, to decrease and/or optimize friction, to improve compressive and/or tensile strength, to improve UV resistance, and/or for any other purpose. In various embodiments, components comprise materials selected based on the cost of the material, the wear requirements of the components, the strength requirements of the components, the weight of the material, and other relevant considerations.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. § 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A splitboard fastening system, comprising:

a crossbar attachment comprising a crossbar having a hook defining an interface;

a set screw configured to adjust a position of the hook relative to a center seam; and a mating component configured to be coupled to a first splitboard ski, wherein the interface is configured to mate with the mating component, wherein:

the crossbar attachment is configured to be coupled to a second splitboard ski, the mating component is configured to be independently coupled to the first splitboard ski, and the mating component further comprises a lever, wherein the lever is rotatable about an axis of rotation.

2. The splitboard fastening system of claim 1, wherein the mating component further comprises a compression stop and a release stop defining an angular range for the lever to move through.

3. The splitboard fastening system of claim 1, wherein the set screw is configured to translate the crossbar in a lateral direction in response to rotation about an axis defined by the set screw.

4. A splitboard fastening system comprising:

a crossbar attachment comprising a crossbar having a hook defining an interface;

a rotation aperture defining an axis of rotation, wherein:

the crossbar attachment is configured to be operably coupled to a first splitboard ski, the interface is configured to mate with a mating component coupled independently to a second splitboard ski, a portion of the crossbar attachment is configured to rotate about the axis of rotation, and the crossbar is configured to move in response to the portion of the crossbar attachment rotating.

5. The splitboard fastening system of claim 4, further comprising an attachment bracket and a set screw, wherein the attachment bracket is configured to translate laterally in response to rotation of the set screw.

6. The splitboard fastening system of claim 5, wherein a position of the attachment bracket is adjustable relative to a center seam.

* * * * *